US008821280B2

(12) United States Patent
Olkin et al.

(10) Patent No.: US 8,821,280 B2
(45) Date of Patent: Sep. 2, 2014

(54) DYNAMIC GAME SYSTEM AND ASSOCIATED METHODS

(71) Applicants: Jake Waldron Olkin, Niwot, CO (US); Terry Michael Olkin, Niwot, CO (US)

(72) Inventors: Jake Waldron Olkin, Niwot, CO (US); Terry Michael Olkin, Niwot, CO (US)

( * ) Notice: Subject to any disclaimer, the term of this patent is extended or adjusted under 35 U.S.C. 154(b) by 0 days.

(21) Appl. No.: 13/771,985

(22) Filed: Feb. 20, 2013

(65) Prior Publication Data

US 2013/0217496 A1 Aug. 22, 2013

Related U.S. Application Data

(60) Provisional application No. 61/600,848, filed on Feb. 20, 2012.

(51) Int. Cl.
*A63F 13/00* (2014.01)

(52) U.S. Cl.
USPC ..... 463/32; 273/236

(58) Field of Classification Search
USPC ..... 463/32; 273/241
See application file for complete search history.

(56) References Cited

U.S. PATENT DOCUMENTS

| | | | | |
|---|---|---|---|---|
| 6,182,967 | B1 | 2/2001 | Green | |
| 6,257,575 | B1 * | 7/2001 | Ortega | 273/241 |
| 7,704,119 | B2 | 4/2010 | Evans | |
| 7,893,646 | B2 | 2/2011 | Yourlo et al. | |
| 2004/0195767 | A1 * | 10/2004 | Randall | 273/237 |
| 2006/0109391 | A1 * | 5/2006 | Huitema et al. | 349/19 |
| 2006/0246403 | A1 * | 11/2006 | Monpouet et al. | 434/128 |
| 2007/0247422 | A1 * | 10/2007 | Vertegaal et al. | 345/156 |
| 2008/0211183 | A1 * | 9/2008 | Cortenraad et al. | 273/237 |
| 2008/0303782 | A1 * | 12/2008 | Grant et al. | 345/156 |
| 2010/0062846 | A1 * | 3/2010 | Orlinsky et al. | 463/30 |
| 2010/0113148 | A1 * | 5/2010 | Haltovsky et al. | 463/30 |
| 2013/0035145 | A1 * | 2/2013 | Kevan | 463/9 |

FOREIGN PATENT DOCUMENTS

JP 2008148721 A * 7/2008

* cited by examiner

*Primary Examiner* — Tramar Harper
(74) *Attorney, Agent, or Firm* — Lathrop & Gage LLP

(57) ABSTRACT

Dynamic game system and associated methods provide a three dimensional dynamic environment for a game or simulation. The dynamic game system includes a controller for generating a dynamic image for the dynamic environment and a flexible game board, in communication with the controller, for displaying the dynamic image. The game board is flexible and provides depth to the three dimensional environment. The controller automatically zooms the dynamic image in and out between detail levels of the game.

8 Claims, 11 Drawing Sheets

DYNAMIC GAME SYSTEM AND ASSOCIATED METHODS

RELATED APPLICATIONS

This application claims priority to U.S. Patent Application Ser. No. 61/600,848, titled "Dynamic Game System and Associated Methods", filed Feb. 20, 2012, and incorporated herein by reference.

BACKGROUND

With conventional board games, the board is typically constructed of a material with a printed surface upon which pieces are placed and moved during a game. That is, the game board is a static, usually horizontal, and often two-dimensional (planar), gaming environment.

DETAILED DESCRIPTION OF THE EMBODIMENTS

Figure 1:
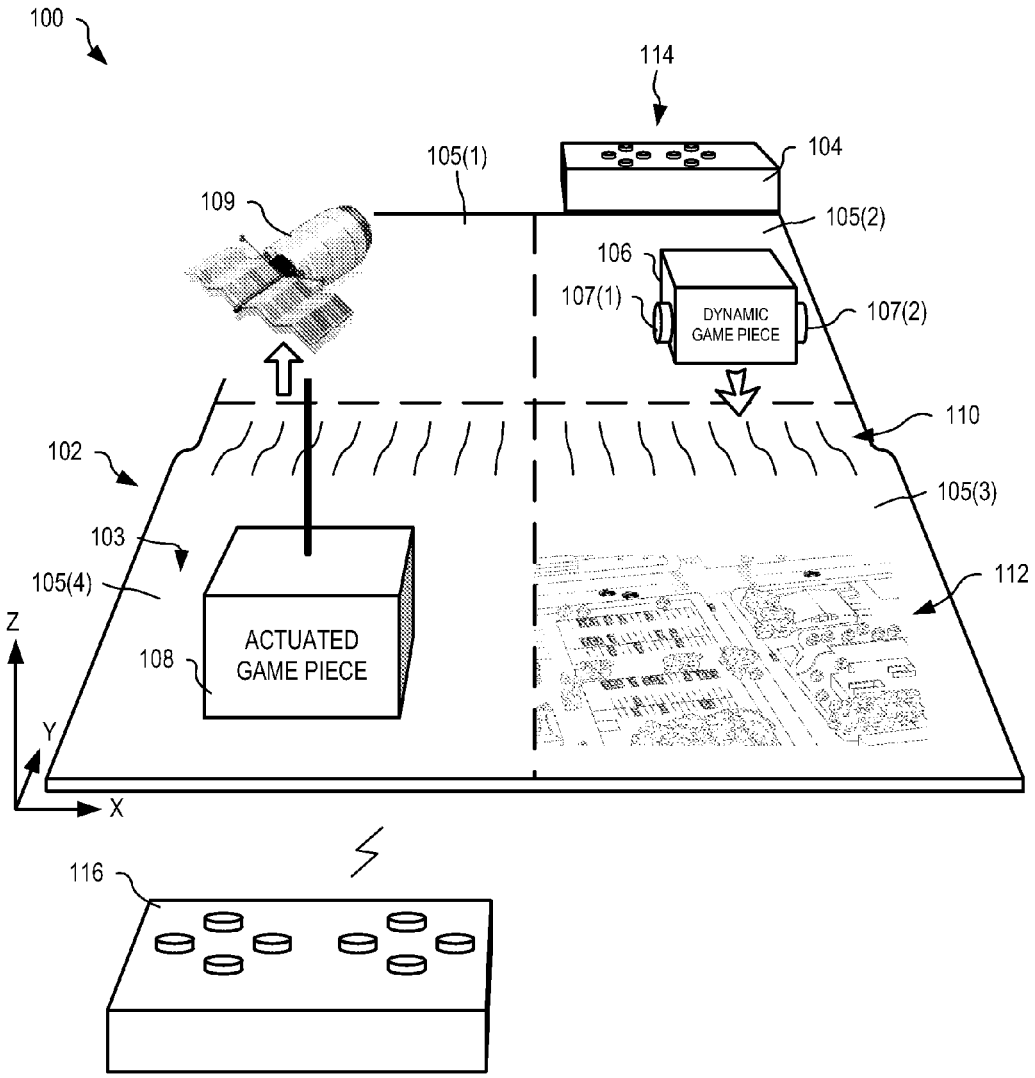
FIG. 1 is a perspective view showing one exemplary dynamic game system, in an embodiment.

FIG. 1 is a perspective view showing one exemplary dynamic game system 100 and is shown with a game board

102 having a display surface 103, a controller 104, a self-moving dynamic game piece 106, and an actuated game piece 108. System 100 may be used for playing games or for simulations. Game board 102 is a flexible display screen that may be molded to a particular topography as required for a particular game. For example, as shown in FIG. 1, game board 102 has an elevation change that forms a ridge 110, thereby adding depth to the game or simulation in progress. In one embodiment, game board 102 is a flexible organic light emitting diode (OLED) display that may flex to form contours and shapes. Although shown rectangular, game board 102 may be constructed in other shapes, as shown in the following examples and embodiments. The flexibility of game board 102 allows it to be rolled up for easy storage, for example.

In one embodiment, game board 102 is formed of a plurality of display segments 105 (see also display segments 1203, 1303, 1403 of FIGS. 12, 13, and 14, respectively) that are controlled by controller 104 and that may be positioned and/or coupled together to form display surface 103. In the example of FIG. 1, display surface 103 is formed of four similarly sized and shaped display segments 105(1)-(4). In one embodiment, game board 102 is formed with a plurality of liquid crystal display (LCD) segments 105 that flexibly couple together and allow contouring. Each display segment 105 that forms display surface 103 need not be rectangular in shape, and the overall shape of game board 102 also need not be rectangular.

Figure 14:
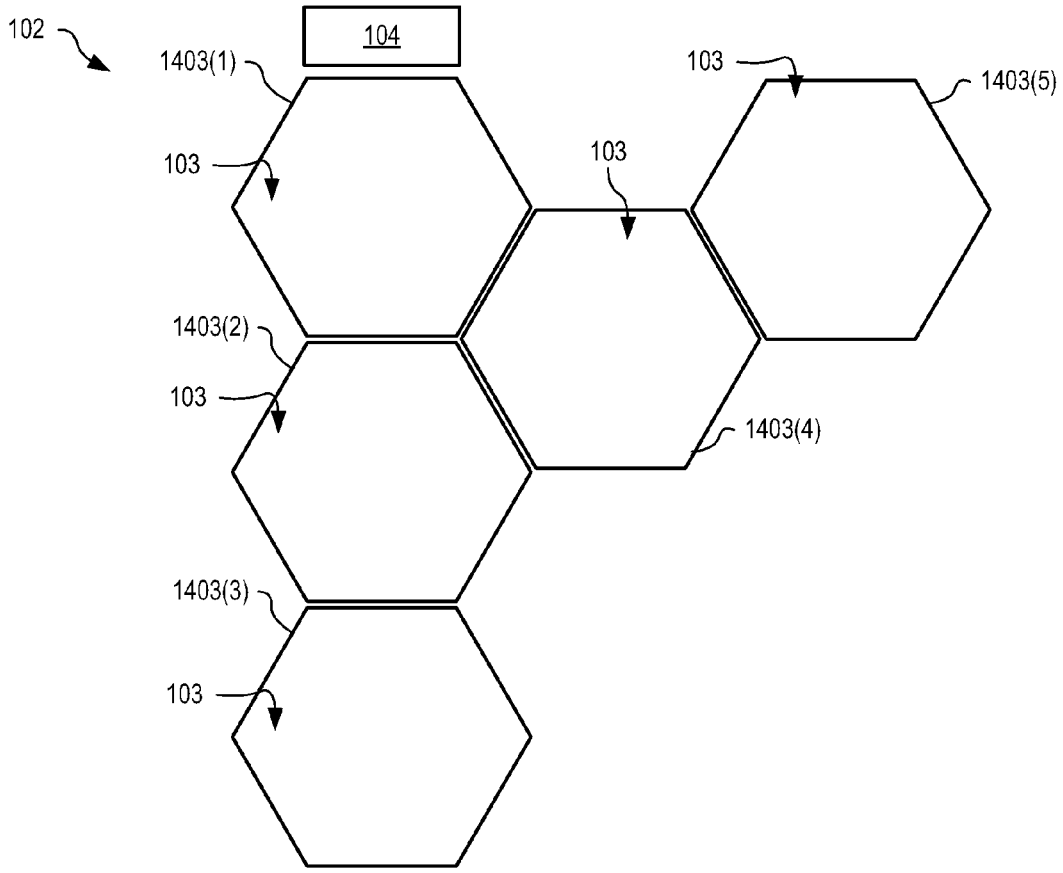
FIG. 14 is a plan view showing the dynamic game system of FIG. 1 with hexagonal display segments, in an embodiment.

In one embodiment, shown in FIG. 14, game board 102 is formed of a plurality of hexagonal display segments 1403 that are positioned and/or coupled together to form display surface 103. The number of display segments 1403 may be selected based upon the game or simulation to be played. In one embodiment, controller 104 is fixedly coupled to first display segment 1403(1), and displays instructions for coupling additional display segments 1403(2)-(5) to each other to form game board 102 for the selected game or simulation. As each display segment is added to form game board 102 it becomes communicatively coupled with controller 104 that may then activate it to display additional connectivity and instructions. In one embodiment, each display segment 1403 has electrical connectivity on each edge such that connecting segments together allows communication with one another and/or with controller 104.

In one embodiment, each display segment 1403 has a unique ID within system 100 and controller 104 generates and distributes an appropriate image for each display segment 1403 based upon positioning of segments 1403 that form display surface 103. Each display segment 1403 may include local electronics for managing and generating its local display based upon instructions and information received from controller 104. In one embodiment, each display segment 1403 includes a graphic processor/controller (not shown) that is similar to circuitry of a display card within a PC. This allows communication between controller 104 and each display segment 1403 to be optimized to reduce the need for continual refreshing of each display segment 1403. In one example of operation, controller 104 "paints" to each display segment 1403 in a way that is similar to the processor of a PC displaying images on two separate displays. Each display segment 1403 may include other functionality that facilitates connectivity to adjacent display segments. In one embodiment, each display segment 1403 propagates/connects a logical message bus to each connected display segment, such that controller 104 may communicate with each display segment 1403 without requiring a direct electrical connection there between. In one example, the logical message bus operates as a parallel bus wherein each display segment 1403 receives all messages from controller 104, but only acts upon messages addressed to that display segment.

In one embodiment, where a display segment 1403 is shaped other than as a conventional rectangle, visible pixels of the display segment are mapped to a portion of a rectangular display area. The graphic processor/controller within the display segment fills the pixels of the rectangular display area that map to visible pixels of the display segment. During game development, a software development kit (SDK) may be provided to game developers to hide such complexity. In one embodiment, system 100 conceptually operates with a single image for the entire game board, wherein software within controller 104 and each display segment 1403 functions to ensure the image is divided and displayed upon appropriate display segments.

Controller 104 controls game board 102 to display one or more static or dynamic (e.g., animated or moving) images 112 on display surface 103 that are appropriate for the game or simulation in progress. Game board 102 may be molded to provide elevation changes that correspond to image 112 displayed thereon to provide a three-dimensional environment for the game play or simulation. In one example of operation, a first image is displayed on game board 102 by controller 104 to indicate a starting position of pieces for the game. Similarly, where a game is paused, controller 104 may display piece positions that allow the previous state of the game to be restored upon request by the user. In another example of use, a current status of a game or simulation may be saved (e.g., a checkpoint) from which the game may be restored if a subsequent play does not result in a desired outcome for the user.

Figure 2:
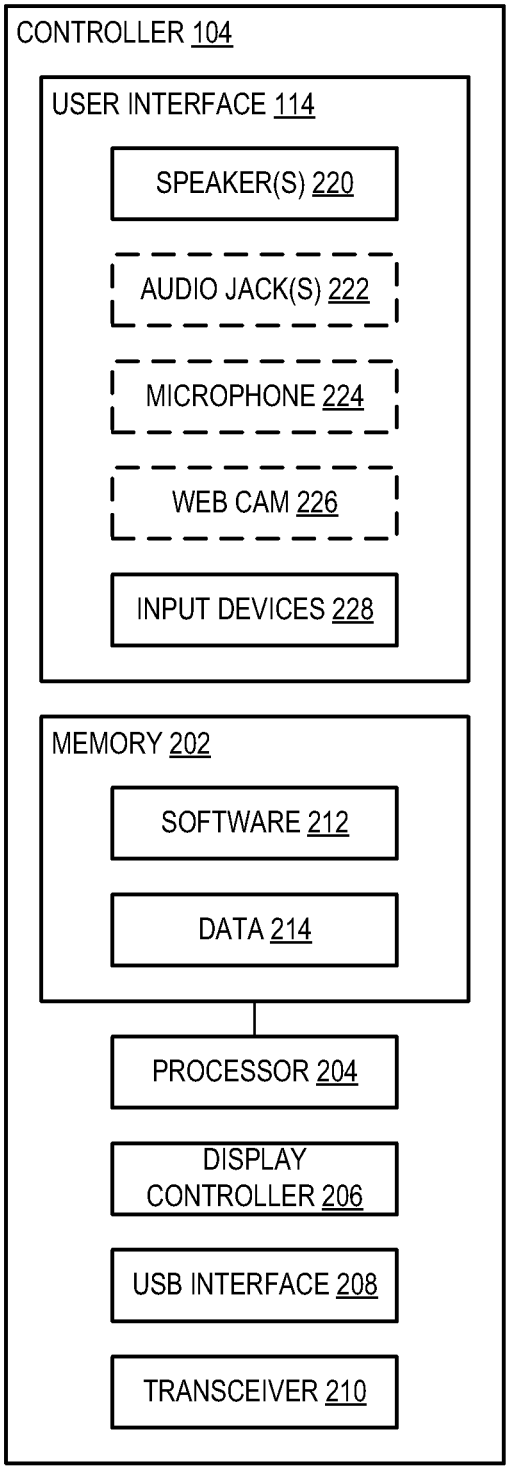
FIG. 2 is a block diagram illustrating key components of the system of FIG. 1.

Controller 104 may provide audio output (e.g., using speakers 220, FIG. 2), for example to add sound effects to game play, or to provide instruction to players using system 100. Speakers 220 may be configured within controller 104, as shown in FIG. 2, or may be configured within game board 102. Controller 104 may change image 112 dynamically during game play and simulation to reflect a current activity. For example, where game play is a war game, and image 112 represents a battle area, controller 104 dynamically changes image 112 to show explosions, smoke and damage to the battle area resulting from weapon fire.

Game board 102 and controller 104 may be used with conventional static playing pieces (e.g., chess pieces, not shown), wherein image 112 is displayed upon display surface 103 to represent a conventional board (e.g., a chess board). Optionally, game board 102 and controller 104 may be used with one or more dynamic game piece 106 and/or one or more actuated game piece 108, together with, or in place of, the one or more conventional game pieces.

Dynamic game piece 106 has wheels 107(1) and 107(2) for self-moving and is in communication with controller 104. Actuated game piece 108 does not move its position, but includes an actuated feature 109, such as the satellite shown in FIG. 1, that is activated by controller 104 for example. Dynamic game piece 106 and actuated game piece 108 are for example robots sized and shaped for play on game board 102.

Controller 104 communicates wirelessly with dynamic game piece 106 and actuated game piece 108. In one embodiment, controller 104 implements a wireless network hub, wherein pieces 106 and 108 communicate with controller 104, and optionally each other, using the wireless network. In an alternate embodiment, one or more of controller 104, dynamic game piece 106, and actuated game piece 108, connects to an existing wireless network (e.g., a Wi-Fi hub or hot spot) to facilitate communication. In yet another embodiment, one or more of controller 104, dynamic game piece 106, and actuated game piece 108, forms a wireless "ad-hoc" network, thereby allowing the devices to communicate directly with each other (peer-to-peer). In yet another embodiment, controller 104 communicates with each game piece 106, 108 using Bluetooth.

Controller 104 may include a user interface 114 that provides a gaming interface (e.g., a plurality of input buttons) for interaction with one or more uses. Controller 104 may also communicate with one or more wireless user interfaces 116 that allow a user to interact with system 100 during game play and simulation. Controller 104 may couple (wired or wirelessly) with other game controllers, such as a gesture recognition device similar to the Microsoft™ Kinect™ device. Wireless user interface 116 is illustratively shown with navigation buttons and selection buttons. However, wireless user interface 116 may also represent one or more of a smart phone (e.g., an iPhone™), a tablet (e.g., an iPad™), and a personal computer, which are configured for interaction with controller 104 and game play and simulation of system 100. For example, a smart phone and a tablet may execute an app, downloaded from an app store, to facilitate communication with controller 104, wherein the app provides a graphical touch interface appropriate for the game or simulation being played on system 100.

System 100 may also communicate with other similar systems to extend game play. In one example of use, two or more systems 100 connect together and cooperate to provide a larger game and simulator environment. In another example of use, two or more systems 100 are remotely located and communicate with each other via the Internet, wherein each system participates in a shared game and simulator environment, displaying a view of at least a portion of that environment to its local player(s). Optionally, each system 100 may communicate with an Internet based server that provides connectivity between the remote systems.

In one example of operation, controller 104 generates image 112 to represent an initial game state, and a user positions one or more game pieces 106, 108 on game board 102. The user interacts with system 100 to control game pieces 106, 108 that move and actuate themselves. Controller 104 controls game board 102 to display effects of the user's (and the user's opponents) actions, optionally moves pieces, and optionally plays sounds.

Figure 15:
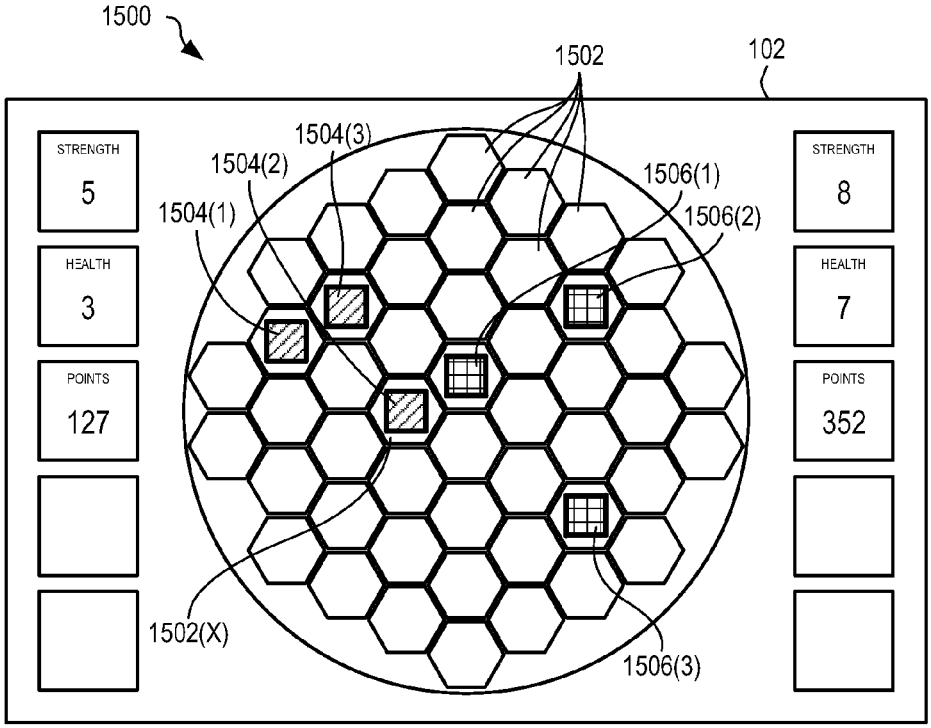
FIG. 15 is a schematic illustrating an exemplary macrospace of a game displayed on the display surface of the game board of the system of FIG. 1, in an embodiment.
Figure 16:
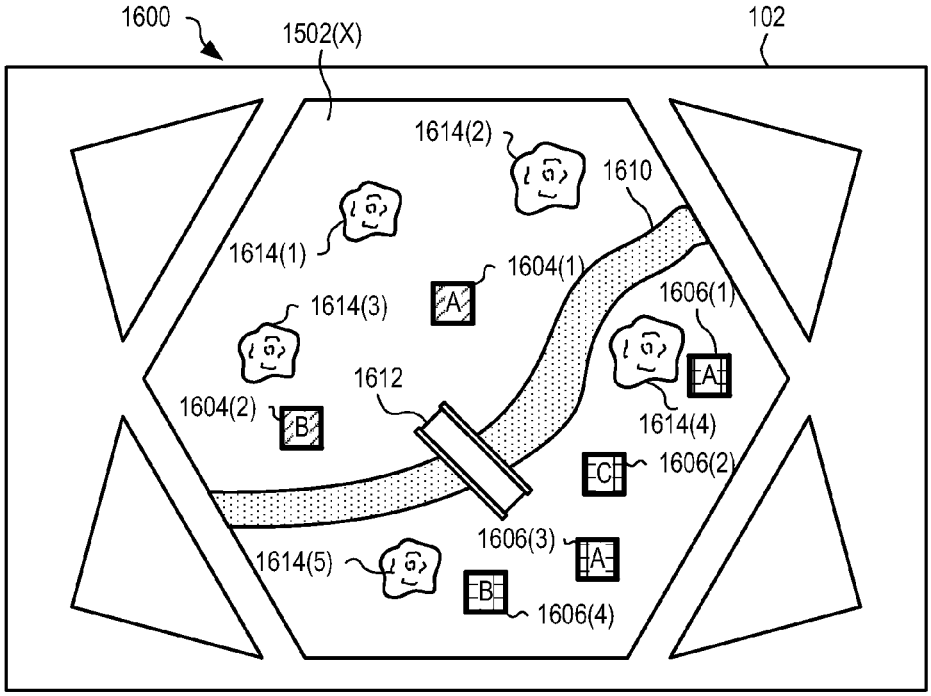
FIG. 16 is a schematic illustrating an exemplary microspace of the game of FIG. 15 displayed on the display surface of the game board of the system of FIG. 1.

Game board 102 may be controlled to "zoom in" to specific action points, or may represent only a portion of a game environment at any one time, wherein game board 102 dynamically changes (and game pieces reposition automatically) as game play moves into a different portion of the game environment. An example of the "zoom in" feature is shown in FIGS. 15 and 16.

FIG. 2 is a block diagram illustrating key components of controller 104 of FIG. 1. Controller 104 is illustratively shown with a memory 202, a processor 204, a display controller 206, at least one USB interface 208, and a transceiver 210. Memory 202 stores software 212 that includes machine readable instructions that, when executed by processor 204, control functionality of system 100 as described herein. Memory 202 also stores data 214 that includes game and simulation moves, configuration parameters, saved game states, and other information necessary for operation of system 100. For example, memory 202 may store saved game states for several different games, allowing the user to restore any one of the saved states to resume play. Memory 202 may represent one or both of volatile memory (e.g., random access memory, dynamic random access memory, and static memory) and non-volatile memory (e.g., read only memory, programmable read only memory, FLASH memory, magnetic storage, and optical storage).

USB interface 208 may be used to connect multiple systems 100 together and/or to connect system 100 to another computer (e.g., a personal computer). USB interface 208 may also connect to other devices (e.g., external hard drives, web cams, a game control device, a keyboard or a mouse) as needed for game play or simulation or for controller maintenance and upgrades (e.g., a firmware upgrade).

Transceiver 210 facilitates wireless connectivity between controller 104 and game pieces 106, 108, between controller 104 and wireless user interface 116, and between controller 104 and another system 100. Transceiver 210 may provide one or more of a Bluetooth interface, a Wi-Fi interface, an ANT interface, Near Field Communication (NFC), and a proprietary wireless interface. For example, transceiver 210 may utilize Wi-Fi for accessing the Internet through a local wireless network and for communication between controller 104 and one or more wireless user interfaces 116, and may utilize Bluetooth for communication between controller 104 and one or more wireless game pieces 106, 108.

Controller 104 is also shown with user interface 114 that includes at least one speaker 220 and input devices 228 (e.g., push buttons, joysticks, and other gaming input options). Although shown within user interface 114 of controller 104, speaker 220 may be configured elsewhere (e.g., within game board 102, or external to both controller 104 and game board 102) without departing from the scope hereof. Optionally, user interface 114 may also include one or more of an audio jack 222, a microphone 224 and a web cam 226, that operate under control of controller 104. Wireless user interfaces 116 may also include one or more of an audio jack, a microphone, input devices and a web cam that may be used to provide input to, and receive output from, controller 104. For example, where wireless user interface 116 represents a tablet or a smart phone, the microphone, speakers, audio jack, and web cam, may already be included. Other input devices may connect to wireless user interface 116 without departing from the scope hereof.

Controller 104 may utilize speaker 220 to provide sound effects for the dynamic actions of game play and simulation and instructions to the user. The one or more audio jacks 222, if included, allow users to connect headphones. Microphone 224, if included, allows the user to make audio inputs (e.g., speech commands) to system 100, and may also allow the user to communicate with other connected users via system 100 and optionally the Internet. If web cam 226 is included, the user may also provide visual input (e.g., gestures) into system 100 and/or have visual communication with other connected users via system 100 and the Internet.

In one embodiment, controller 104 includes power converters and provides power to game board 102.

Figure 3:
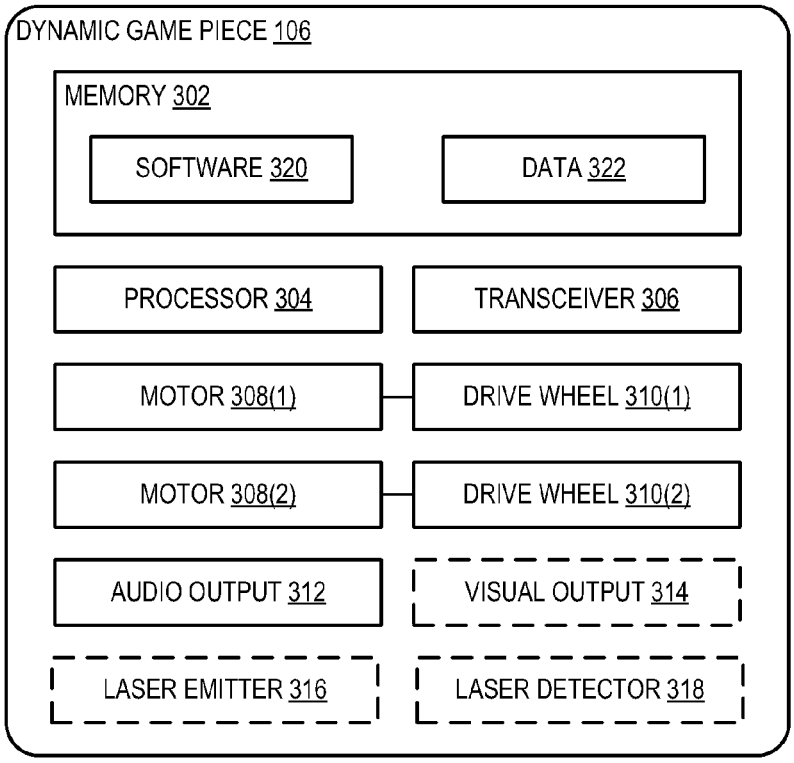
FIG. 3 is a block diagram illustrating one exemplary configuration of the dynamic game piece of FIG. 1.

FIG. 3 is a block diagram illustrating one exemplary configuration of dynamic game piece 106 of FIG. 1. Game piece 106 includes memory 302, a processor 304, a transceiver 306, and first and second motors 308(1) and 308(2) that drive first and second drive wheels 310(1) and 310(2), respectively. Game piece 106 may have fewer or more motors 308 and drive wheels 310 without departing from the scope hereof. Processor 304 controls motors 308 to turn drive wheels 310 to move game piece 106 across the surface of game board 102 based upon instructions received from controller 104. Optionally, dynamic game piece 106 may also include a laser emitter 316 and a laser detector 318 that allows the piece to "fire" (using emitter 316) at another game piece 106, 108 and to determine whether it has been hit (using detector 318) by "fire" from another piece 106, 108. Laser emitter 316 is for example a laser diode that generates a safe low powered laser beam and laser detector 318 is a light sensor that detects incident light from laser emitter 316 (and a laser emitter 416 of actuated game piece 108). Optionally, when a hit is detected, piece 106 communicates this information back to controller 104 which may then take appropriate actions, for example, by updating image 112 to show an explosion where the hit piece is located. In one embodiment, data is encoded within each transmitted laser beam that identifies the firing piece such that the hit piece may identify the piece that fired and prevent false detection.

In one example of operation, in response to interaction with the user, controller 104 may wirelessly send instructions to game piece 106 to move two inches in an X direction on game board 102 and to turn to face a Y direction, wherein game piece 106 first turns to face in the X direction, moves two inches, and then turns to face the Y direction. Controller 104 stores the current location, orientation, and status of each game piece 106 within memory 202 (e.g., as data 214) and controls movement of game piece 106 relative to that position. The user may save and restore the board position at any time through interaction with controller 104, wherein controller 104 uses game board 102 to indicate the position and orientation of each piece. Similarly, if a user accidently moves a piece, the user may interact with controller 104 to request that controller 104 display the position and orientation of that piece, or of the entire game or simulation.

Game piece 106 may also include an audio output 312 (e.g., a speaker) and one or more visual outputs 314 (e.g., LEDs, LCD display, or other visual effects) that are activated by processor 304, executing instruction of software 320, and in response to instruction received from controller 104 and/or other game pieces 106,108. In one example of operation, processor 304 causes an LED of visual output 314 to flash and audio output 312 to generate an explosive sound in response to receiving a hit signal from game piece 108. In another example, controller 104 instructs processor 304 to activate an LCD screen on game piece 106 to display a type of game piece that is represented. That is, game piece 106 is generic and configured for a particular game under control of controller 104. In one embodiment, visual output 314 displays a number to indicate a status of game piece 106 during game play or simulation. In another embodiment, visual output 314 displays a color and/or an icon to indicate to which user/player the piece currently belongs.

Figure 4:
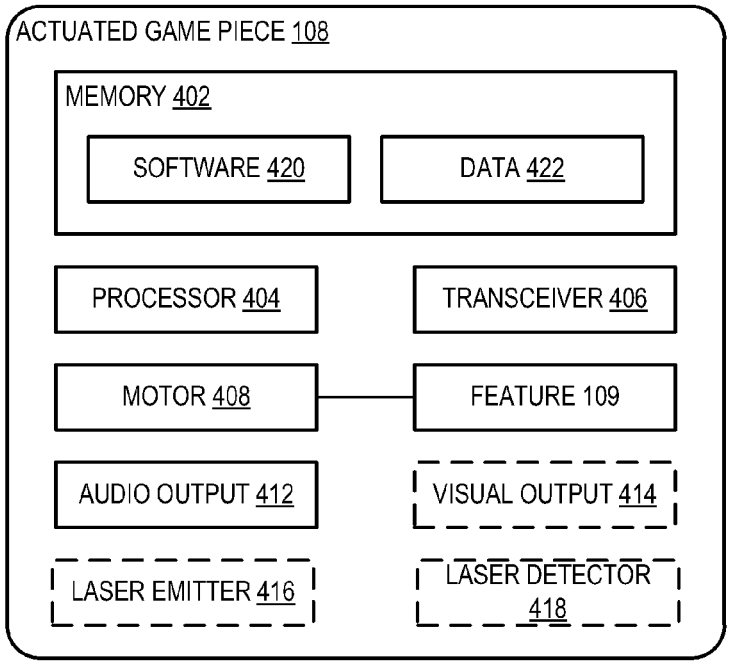
FIG. 4 is a block diagram illustrating the actuated game piece of FIG. 1.

FIG. 4 is a block diagram illustrating one exemplary configuration of actuated game piece 108 of FIG. 1. Game piece 108 includes memory 402, a processor 404, a transceiver 406, and a motor 408 that drives feature 109. Game piece 108 may have more motors 408 and features 109 without departing from the scope hereof. Processor 404 controls motor 408 to activate feature 109 based upon instructions received from controller 104. Optionally, actuated game piece 108 may also include a laser emitter 416 and a laser detector 418 that allows the piece to "fire" (using emitter 416) at another game piece 106, 108 and to determine whether it has been hit (using detector 418) by "fire" from another piece 106, 108. Laser emitter 416 is for example a laser diode that generates a safe low powered laser beam and laser detector 418 is a light sensor that detects incident light from laser emitter 416 (and laser emitter 316 of dynamic game piece 106). Optionally, when a hit is detected, piece 108 communicates this information back to controller 104 which may then take appropriate actions, for example, by updating image 112 to show an explosion where the hit piece is located. In one embodiment, data is encoded within each transmitted laser beam that identifies the firing piece such that the hit piece may identify the piece that fired and prevent false detection.

In one example of operation, in response to interaction with the user, controller 104 may wirelessly send instructions to game piece 108 to activate feature 109, wherein processor 404 activates motor 408 to deploy feature 109. Controller 104 stores the current location, orientation, and status of each game piece 108 within memory 202 (e.g., as data 214) and controls activation of feature 109.

Game piece 108 may also include an audio output 412 (e.g., a speaker) and one or more visual outputs 414 (e.g., LEDs, LCD display, or other visual effects) that are activated by processor 404, executing instruction of software 420, and in response to instruction received from controller 104 and/or other game pieces 106,108. In one example of operation, processor 404 causes an LED of visual output 414 to flash and audio output 412 to generate an explosive sound in response to receiving a hit signal from game piece 106. In another example, controller 104 instructs processor 404 to activate an LCD screen on game piece 108 to display a type of game piece that is represented. That is, game piece 108 is generic and configured for a particular game under control of controller 104. In one embodiment, visual output 414 displays a number to indicate a status of game piece 108 during game play or simulation. In another embodiment, visual output 414 displays a color and/or an icon to indicate to which user/player the piece currently belongs.

In one embodiment, functionality of game pieces 106 and 108 may be combined, wherein the combined game piece may autonomously move across game board 102 and activate one or more features 109, based upon instructions received wirelessly from controller 104.

Each game piece 106, 108 has a number that uniquely identifies it to controller 104. By including the unique number of the game piece being addressed, controller 104 may thereby control each game piece individually. As each game piece is controlled and/or moved across game board 102, image 112 may be modified to indicate a current game or simulation state, or to indicate, locally to a modified game piece 106, 108, a new status of that piece.

In one embodiment, each game piece 106, 108 may be shaped, sized, and colored for a particular game or simulation. For example, features 109 of game piece 108 may be specific to a particular game, wherein the user purchases that game piece to play the game. In one example, game piece 106 is configured to look like a soldier for use in a game where the game pieces fight battles.

Figure 5:
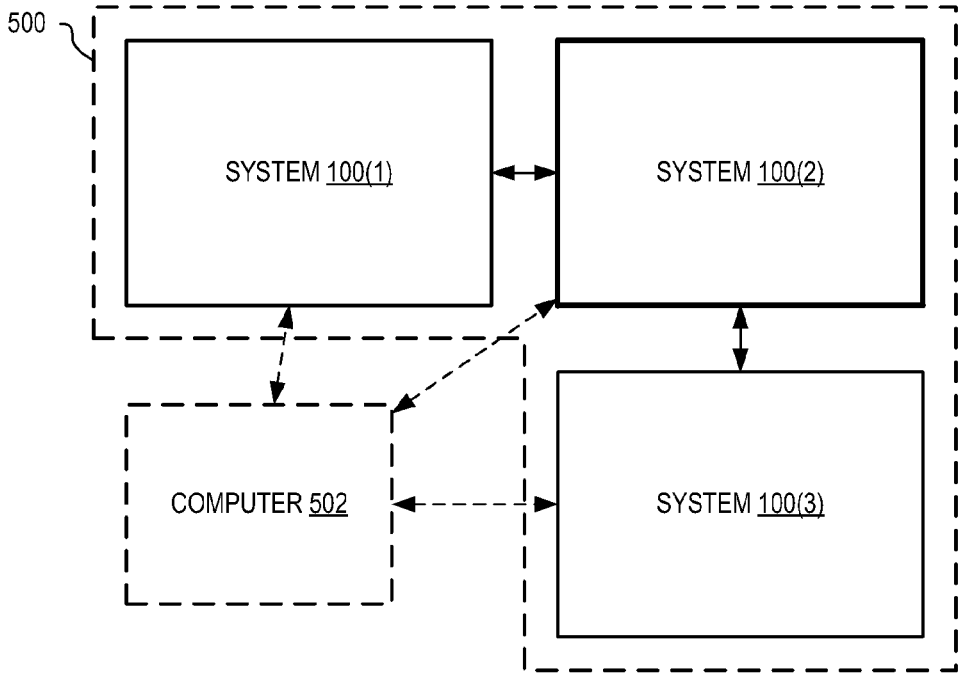
FIG. 5 shows one exemplary game or simulation environment that uses three systems of FIG. 1 that are interconnected.

FIG. 5 shows one exemplary game or simulation environment 500 using three systems 100(1)-(3) that are interconnected (e.g., using USB interface 208 and/or transceiver 210). In the example of FIG. 5, system 100(2) creates and controls environment 500 and systems 100(1) and 100(3) cooperate with system 100(2) to control one or more game pieces 106, 108 positioned therein. In one example of operation, one system (e.g., system 100(2)) is selected to operate as a "master" to provide overall control of environment 500. Once selected as master, system 100(2) broadcasts (e.g., via WiFi Network) configuration information that allows other systems (e.g., systems 100(1) and 100(3)) to join environment 500. In one example of operation, system 100(2) may display a code which is then entered into each of systems 100(1) and 100(3) such that system 100(2) may correctly identify and connect with systems 100(1) and 100(3). This process is similar to pairing between Bluetooth devices for example. In another example, systems 100 may be interconnected using USB cables (e.g., using a serial/daisy-chain configuration) wherein use of a generated code is not required. Communication between systems would then occur through the USB cables. Once systems 100 are configured, the selected "master" maintains (e.g., stores and controls) the state environment 500 and may send instructions to control display segments and game pieces connected via the connected systems. These other systems thereby operate in a "slave" mode to the selected "master". Similarly, status information is received by the "master" system from the other "slave" systems. For example, system 100(2) sends control commands to each of system 100(1) and 100(3), and receives input and status information from system 100(1) and 100(3).

Game boards (e.g., game board 102) of each system 100 may be positioned adjacent to one another to form a larger game environment, or may function independently to each form a related portion of a larger virtual game or simulation environment. Optionally, each system 100 may connect to a separate computer 502 (e.g., a personal computer, notebook, etc.) that executes software for controlling each system 100 collectively or independently.

Figure 6:
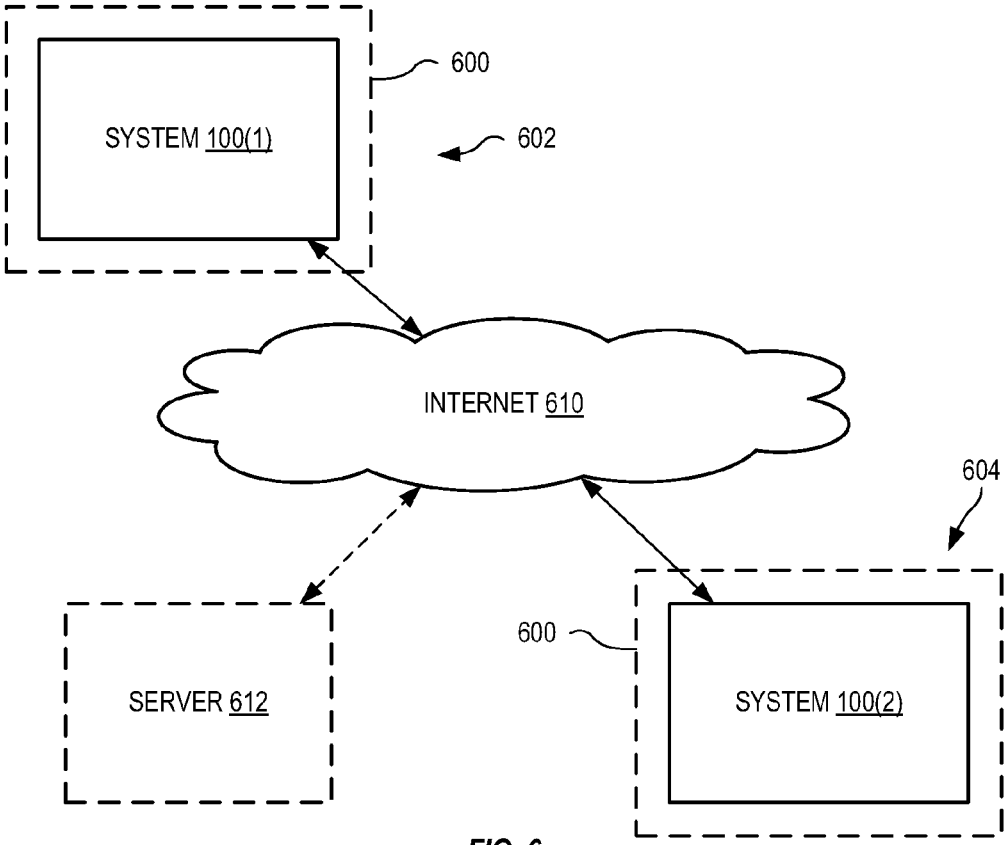
FIG. 6 shows one exemplary game environment that is replicated at two separate locations using two systems of FIG. 1 that are interconnected via the Internet.

FIG. 6 shows one exemplary game environment 600 that is replicated at two separate locations 602, 604 using two systems 100(1) and 100(2) that are interconnected via the Internet. System 100(1) and system 100(2) each provide at least a portion of environment 600 at locations 602, 604, respectively. In one example of operation a first user at location 602 interacts with system 100(1) to play a game within environment 600. A second user at location 604 interacts with system 100(2) to play the same game within the same environment 600, wherein moves made by the first user are sent from system 100(1) to system 100(2) via Internet 610, and moves made by the second user are sent from system 100(2) to system 100(1) via Internet 610. Each system 100(1) and 100(2) thereby performs moves by the first and second users.

Where systems 100(1) and 100(2) includes one or more of microphone 224 and web cam 226 (or a web cam connected via USB interface 208), the first and second users may interact with each other via Internet 610. For example, game play and simulation is enhanced by interaction of the users beyond the game or simulation environment.

Optionally, communication between systems 100 may be facilitated by a server 612 that is accessible via Internet 610. Server 612 may represent one or more physical computers that are communicatively connected and may or may not be co-located. In one embodiment, server 612 generates a web site to which each system 100 connects via Internet 610. Server 612 may also include an online store for purchase of new games to play using system 100. For example, a user may interact with system 100 to instruct controller 104 to purchase and download a new game from server 612, wherein controller 104 stores the downloaded game within memory 202 (e.g., as part of software 212 and/or data 214).

Server 612 may also facilitate development of new games, simulation, and game pieces by third party developers. For example, server 612 may contain a software development kit that defines an application programming interface for game board 102 and game pieces 106, 108, such that the third party developer may generate software that when downloaded and executed by processor 204 of controller 104, controls game board 102 to display a suitable environment (e.g., a game board) and controls movement of game pieces 106, 108 thereon.

In one embodiment, software runs on server 612 to create an environment for a game into which multiple systems 100 may connect and interact. For example, server 612 may generate environment 600 as a game for a plurality of user. System 100 connects to server 612, via Internet 610, such that one or more users may interact with system 100 to play within environment 600. In one example of operation, environment 600 represents an interactive adventure type game where each of a plurality of users, interacting with system 100, moves dynamic game piece 106 through a portion of environment 600 displayed by display surface 103 of system 100. Each portion of environment 600 may represent a "room" that presents the user with one or more puzzles. Items (e.g., tools and objects) may be displayed within the "room" and collected by dynamic game piece 106, where in the object disappears from the display.

Figure 7:
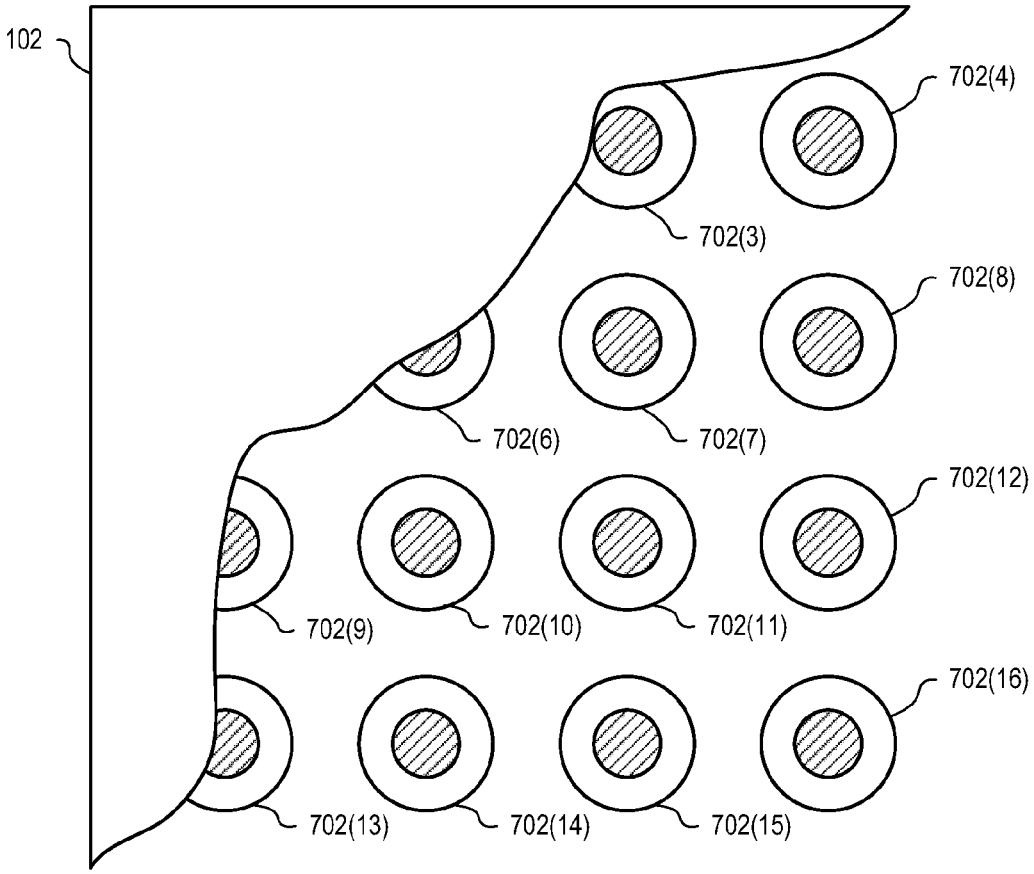
FIG. 7 is a cutaway plan view illustrating the game board of FIG. 1 mounted on top of sixteen self-adjusting height actuators, in an embodiment.
Figure 8:
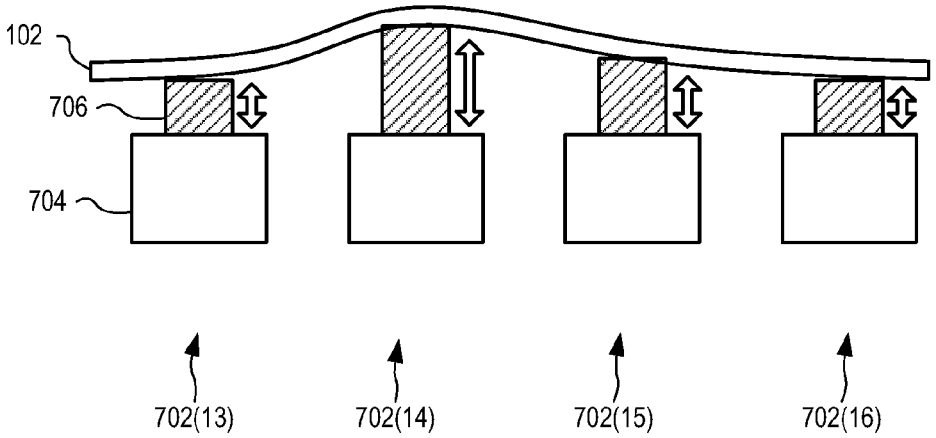
FIG. 8 is a side elevation of the actuators of FIG. 7.

FIG. 7 is a cutaway plan view illustrating game board 102 mounted on top of sixteen self-adjusting height actuators 702 that are controlled by controller 104. FIG. 8 is a side elevation of actuators 702 and game board 102 of FIG. 7. FIGS. 7 and 8 are best viewed together with the following description.

Actuators 702 are similar to each other and each has a base portion 704 and an actuated portion 706. In one embodiment, base portion 704 and actuated portion 706 are threaded, wherein base portion has a motor that turns actuated portion 706 relative to base portion 704 such that actuated portion moves in and out (depending on the motor turning direction) from base portion 704. Game board 102 is supported by, and optionally coupled to, the top of actuated portion 706 such that the area of game board 102 proximate the actuator moves with actuated portion 706.

Although shown with sixteen actuators 702, fewer or more actuator 702 may be used without departing from the scope hereof. Further, although actuators 702 are shown equally distributed, actuators may be otherwise spaced without departing from the scope hereof.

Figure 9:
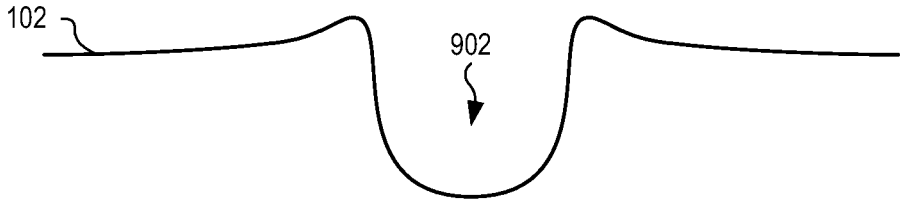
FIG. 9 shows cross-section of the game board of FIGS. 7 and 8 illustrating one exemplary valley.

Actuators 702 are communicatively coupled with controller 104 that operates to adjust height of each actuator 702 to create elevation changes in game board 102. For example, controller 104 may adjust the height of each actuator such that height of each areas of game board 102 resembled terrain depicted by image 112. In one example of operation, image 112 depicts a plan view of a river valley and controller 104 controls actuators 702 to set elevation of the area of game board 102 depicting the river. FIG. 9 shows cross-section of game board 102 that illustrates a valley 902 formed in game board 102 wherein image 112 is positioned on game board 102 such that an animated flowing river appears in valley 902.

In an alternate embodiment, valley 902 is manually formed in game board 102 using a substantially rigid plastic former into which game board 102 is inserted, wherein the former bends game board 102 to form valley 902. In one example of use, a game requires the user to construct a bridge over the flowing river to allow a dynamic game piece 106 to cross.

Figure 10:
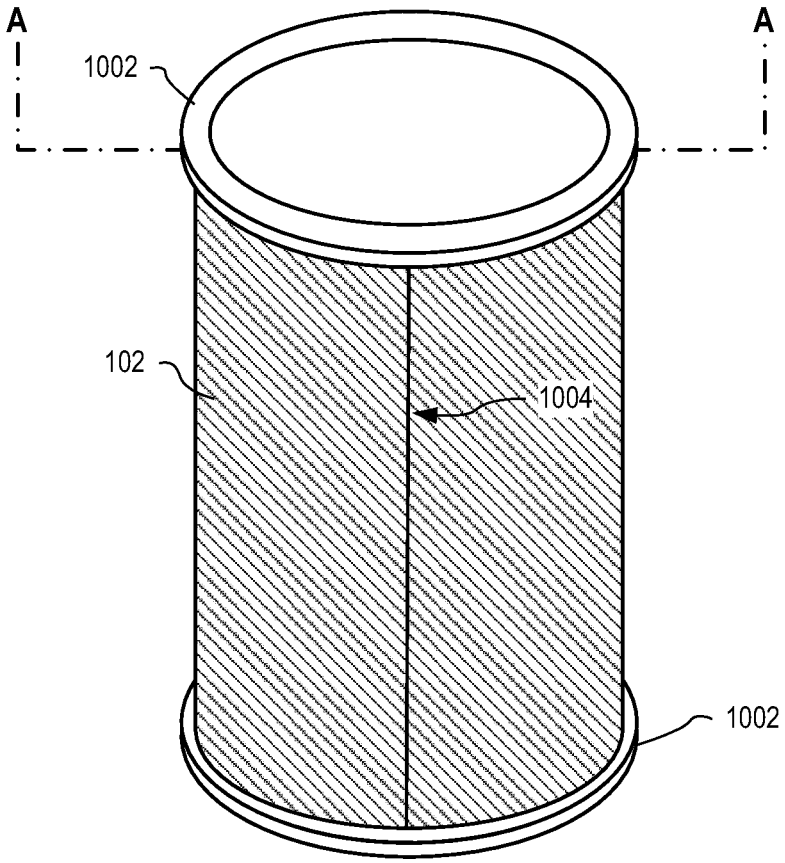
FIG. 10 shows one exemplary former into which the game board of FIG. 1 102 is inserted to form a substantially cylindrically shaped screen, in an embodiment.
Figure 11:
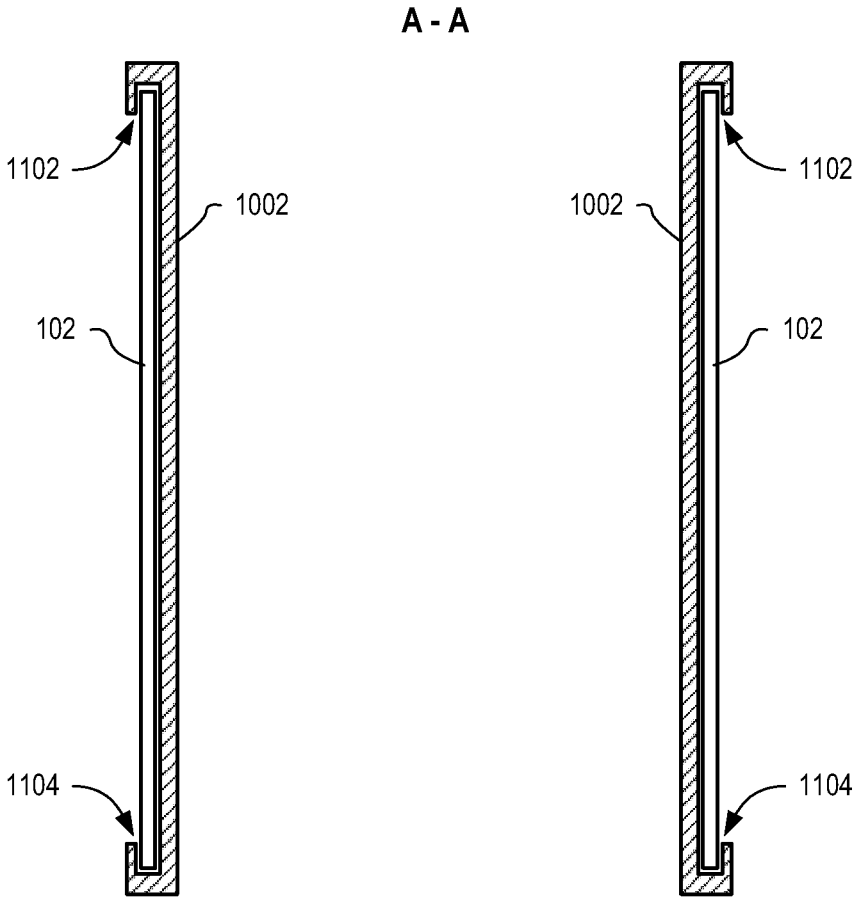
FIG. 11 is a cross-section through the former and game board of FIG. 10.

FIG. 10 shows one exemplary former 1002 into which game board 102 is inserted to form a substantially cylindrically shaped screen. FIG. 11 is a cross-section through former 1002 and game board 102 of FIG. 10 illustrating game board 102 inserted into, and retained by, slots 1102, 1104 of former 1002 to form the substantially cylindrical shaped screen with a seam 1004.

In one embodiment, former 1002 and game board 102 are each formed of smaller parts that are assembled together to form the substantially cylindrical screen. For example, former 1002 may be formed of quarter cylinders parts that snap together to form former 1002. Similarly, game board 102 may be formed as a plurality of smaller flexible screens that may be inserted into former 1002 to form the substantially cylindrical screen. Note that the parts of game board 102 are not necessarily connected to each other, but connect to, and are controlled by, controller 104.

In one embodiment, game board 102 is rolled to form a substantially cylindrical shape that is held in place by a former that clamps ends of game board 102 together at seam 1004, wherein the cylindrical shape is maintained by rigidity of game board 102.

In one example of use, the cylindrical screen represents a three dimensional view of the ocean, where the bottom of the screen represents deep water and shows submerged vessels moving therein and the top represents the sky and shows vessels floating on the surface of the water. Vessels may be displayed smaller and bigger relative to each other to give the impression of a three-dimensional view.

Dynamic game pieces 106 may also be used on game board 102 configured within former 1002 by using a mechanism (not shown) that attaches each game piece 106 to the top of former 1002, thereby allowing the game piece to traverse the surface of game board 102. In one embodiment, game piece 106 may traverse vertically using the mechanism. In another embodiment, game piece 106 may also traverse laterally whereby the supporting mechanism pivots around former 1002 thereby allowing the game piece to traverse the display screen horizontally.

Figure 12:
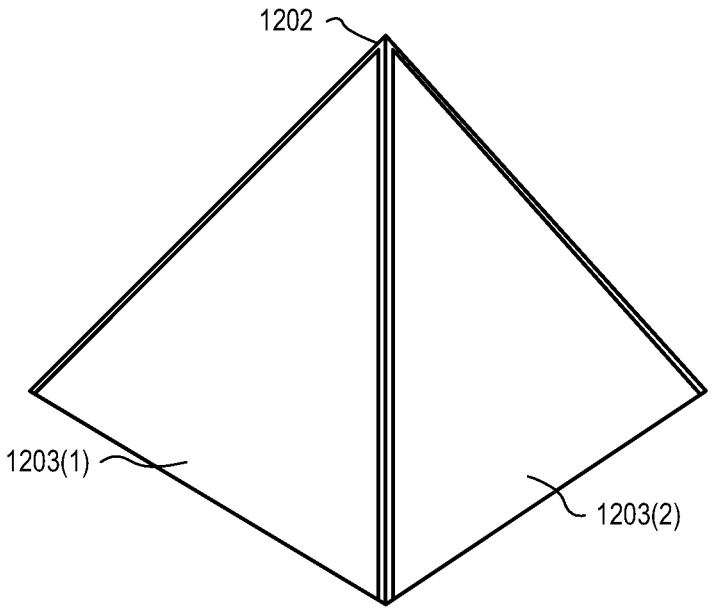
FIG. 12 is a perspective view illustrating one exemplary former for configuring the game board of FIG. 1 in a pyramid shape, in an embodiment.

FIG. 12 is a perspective view illustrating one exemplary former 1202 into which game board 102 may be inserted to form a pyramid shape. Former 1202 has a substantially square shaped base with four triangular shaped sides. In this embodiment, game board 102 is formed of four triangular shaped display segments 1203 that may be inserted into, and retained by, slots of former 1202 to form the pyramid shape.

Figure 13:
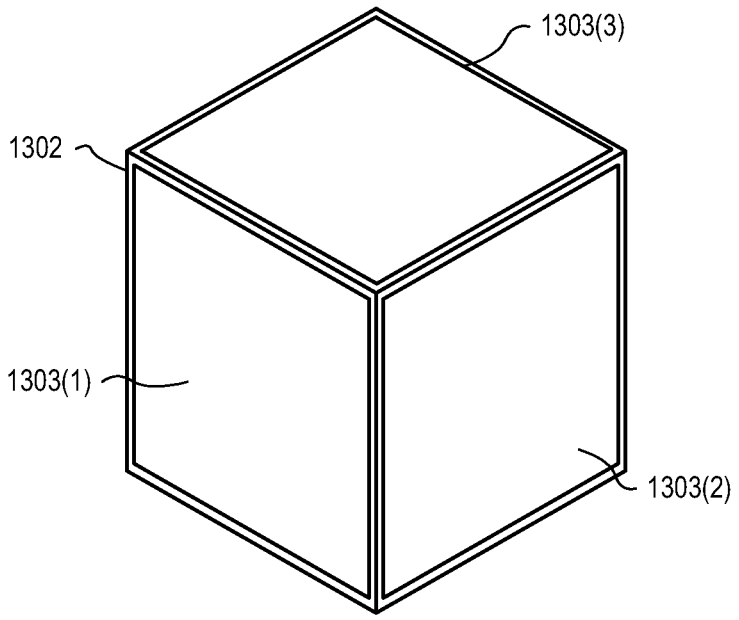
FIG. 13 is a perspective view illustrating one exemplary former for configuring the game board of FIG. 1 in a cube shape, in an embodiment.

FIG. 13 is a perspective view illustrating one exemplary former 1302 into which game board 102 of FIG. 1 may be inserted to form a cube shape. Former 1302 has a substantially square shaped base, four square shaped sides, and a square shaped top. In this embodiment, game board 102 is formed of five square shaped display segments 1303 that may be inserted into, and retained by, slots of former 1302 to form the cube shape.

FIG. 15 is a schematic illustrating an exemplary macrospace 1500 of a game displayed on display surface 103 of game board 102 by system 100 of FIG. 1. FIG. 16 is a schematic illustrating an exemplary microspace 1600 of the game of FIG. 15. FIGS. 15 and 16 are best viewed together with the following description. Macrospace 1500 represents a larger area of game play with less detail, whereas microspace 1600 represents a smaller area of game play with more detail.

In the example of FIG. 15, each hex represents a playing space within macrospace 1500 of a designated terrain type, such as one of hills, marsh, plains, woods, mountains, and so on. Although not shown for clarity of illustration, each terrain type may be represented by a different color on display surface 103 such that the players may easily identify the terrain type of each playing space. Although shown with forty-eight hexagonal playing spaces, game board 102 may display playing spaces of other shapes and sizes as required by the game being played.

In the example game shown in FIG. 15, a first of two players has three game pieces 1504(1)-(3) and the other player also has three game pieces 1506(1)-(3). Each piece 1504, 1506 may be implemented by dynamic game piece 106 with the ability to move itself under control of controller 104. Piece 1504(2) of the first player occupies playing space 1502(X) and the other player indicates to controller 104 that game piece 1506(1) is to move onto playing space 1502(X). Controller 104 then controls game board 102 to zoom in on playing space 1502(X) and automatically moves game pieces 1504 and 1506 into appropriate positions for microspace 1600 that is then displayed, as a result of the zoom in, of display surface 103. In this example, each playing piece 1504, 1506 within macrospace 1500 may represent one or more playing pieces 1604, 1606 within microspace 1600.

In the example of FIG. 16, microspace 1600 represents playing space 1502(X) of macrospace 1500 and shows a plan view of a different level within the displayed game. Although microspace 1600 is shown as a hexagonal shape to match playing space 1502(X), microspace 1600 could be any shape. Microspace 1600 is illustratively shown with a river 1610, a bridge 1612 crossing river 1610, and several trees 1614. Controller 104 automatically moves game pieces 1504, 1506 into appropriate positions within microspace 1600, illustratively shown as game pieces 1604, 1606. Controller 104 may also instruct each game piece to display a different color and/or symbol to represent an appropriate piece. In the example of FIG. 16, game piece 1604(1) utilizes a color to indicate the player to which it belongs and a symbol (A) to indicate the type of game piece that it represents. Controller 104 may add or remove pieces to microspace 1600 as needed. In one example, a game piece previously playing for the first player may change color to play for the other player based upon its position, known to controller 104, on game board 102.

Game play then continues within microspace 1600. Controller 104 may cause game board 102 to display animations on display surface 103 to make game play more realistic. In one example where the game being played is a battle, controller 104 causes game board 102 to show effects of game play, such as explosions, craters, etc.

In one embodiment, features (e.g., trees 1614, bridge 1612, river 1610 and so on) within microspace 1600 are randomly generated based upon the type of terrain represented by playing space 1502(X). For example, specific details of microspace 1600 may be randomly generated so that microspace 1600 is different each time, wherein complexity and difficulty of game play within microspace 1600 may be selected by the players at the start of the game.

System 100 offers many advantages over conventional board games by automatically "zooming in" to a micro level as required for game play and by automatically moving and assigning game pieces 1504, 1506, 1604, 1606.

Where the type of terrain represents hills and/or mountains, height actuators 702 may be controlled by controller 104 to make elevation changes to game board 102 to match displayed images 112 on display surface 103.

In one embodiment, where different dynamic pieces 106 are to be used for microspace 1600, controller 104 moves playing pieces 1504, 1506 off of game board 102 and moves other playing pieces 1604, 1606 onto game board 102.

When game play within microspace 1600 is finished, such as when one army defeats the other, or when one army retreats, controller 104 zooms out of microspace 1600 to return to macrospace 1500, repositioning and reassigning playing pieces 1504, 1506, as appropriate.

System 100 may allow any type of game where players move through a large world-space and have adventures in local spaces of that world to be played and use this zoom in feature.

Figure 17:
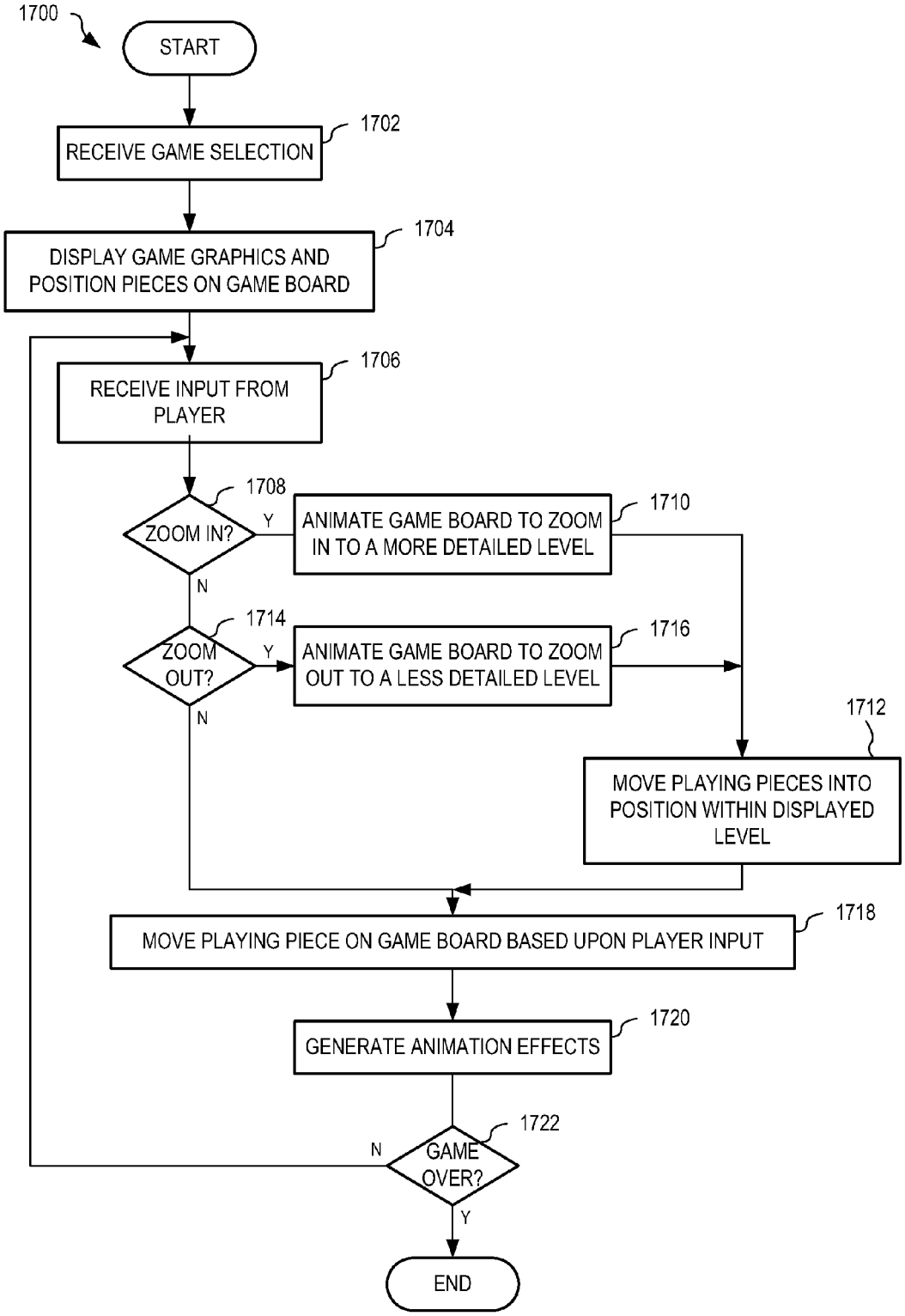
FIG. 17 is a flowchart showing one exemplary method for playing a game on the system of FIG. 1, in an embodiment.

FIG. 17 is a flowchart showing one exemplary method 1700 for playing a game on system 100 of FIG. 1. Method 1700 is implemented within controller 104, for example.

In step 1702, method 1700 receives a game selection from a player. In one example of step 1702, controller 104 receives a selection of a game from a player of system 100. In step 1704, method 1700 displays the game graphics and positions pieces on the game board. In one example of step 1704, controller 104 displays a macrospace 1500 on display surface 103 of game board 102 and positions dynamic playing pieces 1504, 1506 on game board 102. In step 1706, method 1700 receives an input from a player. In one example of step 1706, controller 104 receives an input from a player of system 100.

Step 1708 is a decision. If, in step 1708, method 1700 determines that a "zoom in" is required, method 1700 continues with step 1710; otherwise method 1700 continues with step 1714. In one example of step 1708, controller 104 determines from the input of step 1706 that the next move requires a microspace (more detailed level) to be displayed and proceeds with step 1710. In step 1710, method 1700 animates the game board to zoom in to a more detailed level. In one example of step 1710, controller 104 generates an animation on display surface 103 to "zoom in" to microspace 1600 from macrospace 1500.

In step 1712, method 1700 moves playing pieces into position within the displayed level. In one example of step 1712, controller 104 controls each of a plurality of dynamic playing pieces 106 to position themselves on game board 102 in association with the displayed image. Method 1700 continues with step 1718.

Step 1714 is a decision. If, in step 1714, method 1700 determines that a "zoom out" is required, method 1700 continues with step 1716; otherwise method 1700 continues with step 1718. In one example of step 1714, controller 104 determines from the input of step 1706 that the battle within microspace 1600 is done, that a macrospace (more abstract level) is to be displayed, and proceeds with step 1716. In step 1716, method 1700 animates the game board to zoom out to a less detailed level. In one example of step 1716, controller 104 generates an animation on display surface 103 to "zoom out" from microspace 1600 so macrospace 1500. Method 1700 then continues with step 1712, described above.

In step 1718, method 1700 moves playing piece on game board based upon the player input. In one example of step 1718, controller moves dynamic playing piece 106 on game board 102 based upon input received in step 1706. In step 1720, method 1700 generates animation effects. In one example of step 1720, controller 104 controls game board 102 to display graphical effects based upon the move made in step 1718.

Step 1722 is a decision. If, in step 1722, method 1700 determines that the game is over, method 1700 terminates; otherwise method 1700 continues with step 1706. Steps 1706 through 1722 repeat until the game terminates.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A dynamic game system for providing a three dimensional dynamic environment for a game, comprising:

a controller for generating a dynamic image for the dynamic environment;

a game board, in communication with the controller, having a display surface with at least two display segments that cooperate under control of the controller to form the display surface, deformable in depth, for displaying the dynamic image; and two or more actuators for supporting the game board, wherein the actuators are controlled by the controller to dynamically change the elevation of at least part of the game board relative to other parts of the game board.

2. The system of claim 1, further comprising a dynamic game piece in communication with the controller, wherein the dynamic game piece moves itself on the game board under control of the controller.

3. The system of claim 1, further comprising an actuated game piece in communication with the controller, wherein the actuated game piece includes an actuated feature that moves relative to the game piece under control of the controller.

4. The system of claim 1, the controller comprising an interface for communicating with one or more additional dynamic game systems, wherein the controller and the one or more additional dynamic game systems cooperate to form a single environment for a game or simulation.

5. The system of claim 4, wherein a portion of the single environment is displayed on each of the system and the one or more additional dynamic game systems.

6. The system of claim 1, further comprising a server in communication with the controller via the Internet, wherein the server comprises an online store for selling and downloading one or both of games and simulations to the controller.

7. The system of claim 1, further comprising a form for securing the display segments together to have a predefined three-dimensional shape.

8. The system of claim 1, wherein the controller controls the dynamic image to automatically zoom in to a more detailed level of the game, and to automatically zoom out to a less detailed level of the game, based upon game play.

* * * * *